US011180920B1

(12) United States Patent
Pratt

(10) Patent No.: US 11,180,920 B1
(45) Date of Patent: Nov. 23, 2021

(54) GUTTER HANGER WITH GUIDE TAB

(71) Applicant: John Pratt, Bethlehem, CT (US)

(72) Inventor: John Pratt, Bethlehem, CT (US)

( * ) Notice: Subject to any disclaimer, the term of this patent is extended or adjusted under 35 U.S.C. 154(b) by 0 days.

(21) Appl. No.: 17/062,944

(22) Filed: Oct. 5, 2020

(51) Int. Cl.
*E04D 13/072* (2006.01)
*E04D 13/068* (2006.01)

(52) U.S. Cl.
CPC ..... *E04D 13/0725* (2013.01); *E04D 13/068* (2013.01); *E04D 13/0722* (2013.01); *E04D 13/0727* (2013.01)

(58) Field of Classification Search
CPC ..... E04D 13/0725; E04D 13/076; E04D 13/0727; E04D 13/0481; E04D 13/068; E04D 13/072; E04D 13/0722; B25H 1/0078; B23B 47/28
USPC ..... 248/547
See application file for complete search history.

(56) References Cited

U.S. PATENT DOCUMENTS 2,831,376 A * 4/1958 Daniels ..... B25H 1/0078 408/16
3,053,491 A * 9/1962 Ramser ..... E04D 13/0725 248/48.2
3,126,181 A * 3/1964 Steeg ..... E04D 13/0725 248/48.2
4,169,570 A * 10/1979 Morin ..... E04D 13/0725 248/48.2
4,294,422 A * 10/1981 Odekirk ..... E04D 13/0725 248/216.1
4,314,683 A * 2/1982 Cunning ..... E04D 13/0725 248/48.2
4,733,812 A 3/1988 Lewis et al.
4,874,123 A 10/1989 Mercer, II et al.
5,007,224 A 4/1991 Segneri
5,388,377 A * 2/1995 Faulkner ..... E04D 13/0725 52/11
5,617,678 A * 4/1997 Morandin ..... E04D 13/0725 248/48.2
5,737,879 A * 4/1998 Sweet ..... E04D 13/0725 248/48.1
5,791,834 A * 8/1998 Zehrung ..... B23B 47/28 408/1 R
6,209,826 B1 4/2001 Pratt, Jr.
6,631,587 B2 10/2003 Lynch
6,658,796 B1 * 12/2003 Higgins ..... E04D 13/0725 248/48.2
7,071,418 B2 * 7/2006 Brockman ..... H02G 3/32 174/154
7,153,070 B1 * 12/2006 Schroeder ..... B23B 47/281 408/115 R
7,494,095 B2 2/2009 Walker et al.
7,523,894 B1 * 4/2009 Eddy ..... E04D 13/0725 248/216.1
7,861,980 B1 * 1/2011 Verbrugge ..... E04D 13/076 248/48.2
7,896,296 B2 * 3/2011 Julian ..... F16L 3/127 248/68.1

(Continued)

*Primary Examiner* — Jonathan Liu
*Assistant Examiner* — Taylor L Morris
(74) *Attorney, Agent, or Firm* — Cantor Colburn LLP

(57) ABSTRACT

A gutter hanger includes a main body; a rear clip at a first end of the main body; a front hook at a second end of the body; at least one guide tab extending from the main body, the at least one guide tab sized and positioned to align a drive tool relative to the main body.

13 Claims, 2 Drawing Sheets

(56) References Cited

U.S. PATENT DOCUMENTS

| | | | | |
|---|---|---|---|---|
| 8,997,403 | B1 * | 4/2015 | Steinberg | E04D 13/076 52/12 |
| 10,131,050 | B1 * | 11/2018 | Cattaneo | B24B 23/005 |
| 10,233,647 | B2 * | 3/2019 | Elliott | F16B 2/22 |
| 10,267,043 | B2 * | 4/2019 | Conner | E04D 13/0725 |
| 2003/0061770 | A1 * | 4/2003 | Lynch | E04D 13/0725 52/11 |
| 2004/0250478 | A1 * | 12/2004 | McDonald | E04D 13/0725 52/11 |
| 2005/0005526 | A1 * | 1/2005 | Teed | E04D 13/0725 52/11 |
| 2005/0172565 | A1 * | 8/2005 | Riley | E04D 13/076 52/12 |
| 2006/0201069 | A1 * | 9/2006 | Richard | E04D 13/076 52/12 |
| 2008/0029654 | A1 * | 2/2008 | Iannelli | E04D 13/0725 248/48.2 |
| 2011/0041414 | A1 * | 2/2011 | Bell | E04D 13/0725 52/12 |
| 2011/0126477 | A1 * | 6/2011 | Hum | E04D 13/076 52/12 |
| 2011/0138696 | A1 * | 6/2011 | Olson | E04D 13/076 52/12 |
| 2014/0196400 | A1 | 7/2014 | Bell | |

* cited by examiner

GUTTER HANGER WITH GUIDE TAB

BACKGROUND

There are various techniques for installing gutter on buildings. One of the currently popular approaches is to position a bracket inside the gutter, and then to screw the assembly through the back panel of the gutter, thereby attaching it to the building fascia. The brackets may be made to accept a gutter screw through a hole in the back of the hanger, or alternatively, they may include a captive screw that is installed in the hanger at the place of manufacture.

SUMMARY

An embodiment includes a gutter hanger including a main body; a rear clip at a first end of the main body; a front hook at a second end of the body; at least one guide tab extending from the main body, the at least one guide tab sized and positioned to align a drive tool relative to the main body.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
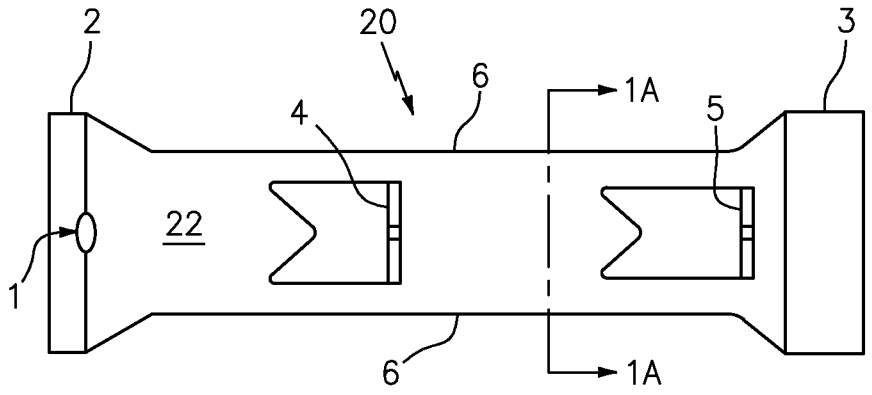
FIG. 1 is a plan view of a gutter hanger in an example embodiment.
Figure 1A:
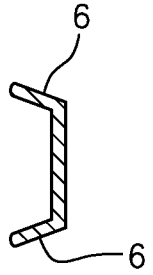
FIG. 1A is a cross-sectional view along lines 1A-1A of FIG. 1.

FIG. 1 depicts a gutter hanger 20 in an example embodiment. The gutter hanger 20 may be formed from a single sheet of material (e.g., sheet metal) which is bent, stamped, drilled and otherwise manufactured to form the gutter hanger 20. The gutter hanger 20 include a main body 22. A back clip 2 is positioned at a rear, first distal end of the main body 22. The back clip 2 includes a centered back hole 1 for the passage of a gutter screw 11 (FIG. 3) to fasten the gutter to a building fascia. A front hook 3 is positioned at a front, second distal end of the main body 22. As shown in FIG. 1A, the main body 22 may be formed with sides 6 bent up or down (e.g., c-shaped) for adding strength to the main body 22.

The main body 22 includes a rear, first guide tab 4 and a front, second guide tab 5. As described in further detailed herein, the first guide tab 4 and the second guide tab 5 align a drive tool to facilitate securing the gutter hanger to a building facia. The first and second guide tabs 4 and 5 are stamped from the material in the main body 22 and bent up 90 degrees from the main body 22. In other embodiments, a single guide tab is used, rather than two guide tabs. The first and second guide tabs 4 and 5 may be bendable relative to the main body 22. The first and second guide tabs 4 and 5 may be bent downwards towards the main body 22 after installation.

Figure 2:
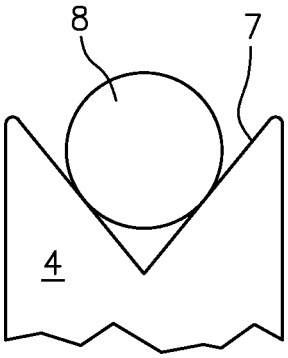
FIG. 2 depicts a first guide tab in an example embodiment.

FIG. 2 shows the first guide tab 4 which includes a first guide notch 7. The first guide notch 7 is V shaped in the example of FIG. 2, but may have other shapes in alternate embodiments. The first guide notch 7 is sized and positioned to receive and guide a portion of a drive tool, such as a chuck 8 on a drive tool 15 (FIG. 3).

Figure 3:
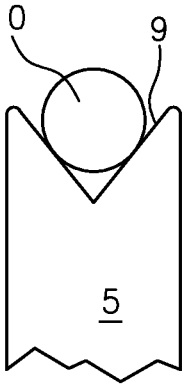
FIG. 3 depicts a second guide tab in an example embodiment.

FIG. 3 shows the second guide tab 5 which includes a second guide notch 9. The second guide notch 9 is V shaped in the example of FIG. 3, but may have other shapes in alternate embodiments. The second guide notch 9 is sized and positioned to receive and guide a portion of a drive tool, such as a shank 10 of the zip screwdriver 15 (FIG. 3). In the example in FIGS. 2 and 3, the width of the opening of the first guide notch 7 is greater than the width of the opening of the second guide notch 9. It is understood that the sizes of the first guide notch 7 and the second guide notch 9 maybe varied and are not limited to the sizes in FIGS. 2 and 3. An axis passing through the bottom of the first notch 7 and the bottom of the second notch 9 forms an acute angle with respect to the plane of the main body 22.

The first guide notch 7 and second guide notch 9 are V-shaped in FIGS. 2 and 3. Round or square guide notches may be used in other embodiments. The V-shaped guide notches 7 and 9 accommodate different chuck and shank diameters of a drive tool. Observed common size ranges include chuck diameters of about 0.430 inches to about 0.440 inches (0.010 inches variation) and shank diameters of about 0.310 inches to about 0.350 inches (0.040 inches variation).

The second guide tab 5 has a height, measured from the main body 22 to an end of the second guide tab 5, greater than the height of the first guide tab 4, measured from the main body 22 to an end of the first guide tab 4. The heights of the first guide tab 4 and the second guide tab 5 and sizes of the first notch 7 and the second notch 9 are selected to provide an angle "a" between the plane of the main body 22 and a longitudinal axis "x" of the drive tool 15 (FIG. 4).

Figure 4:
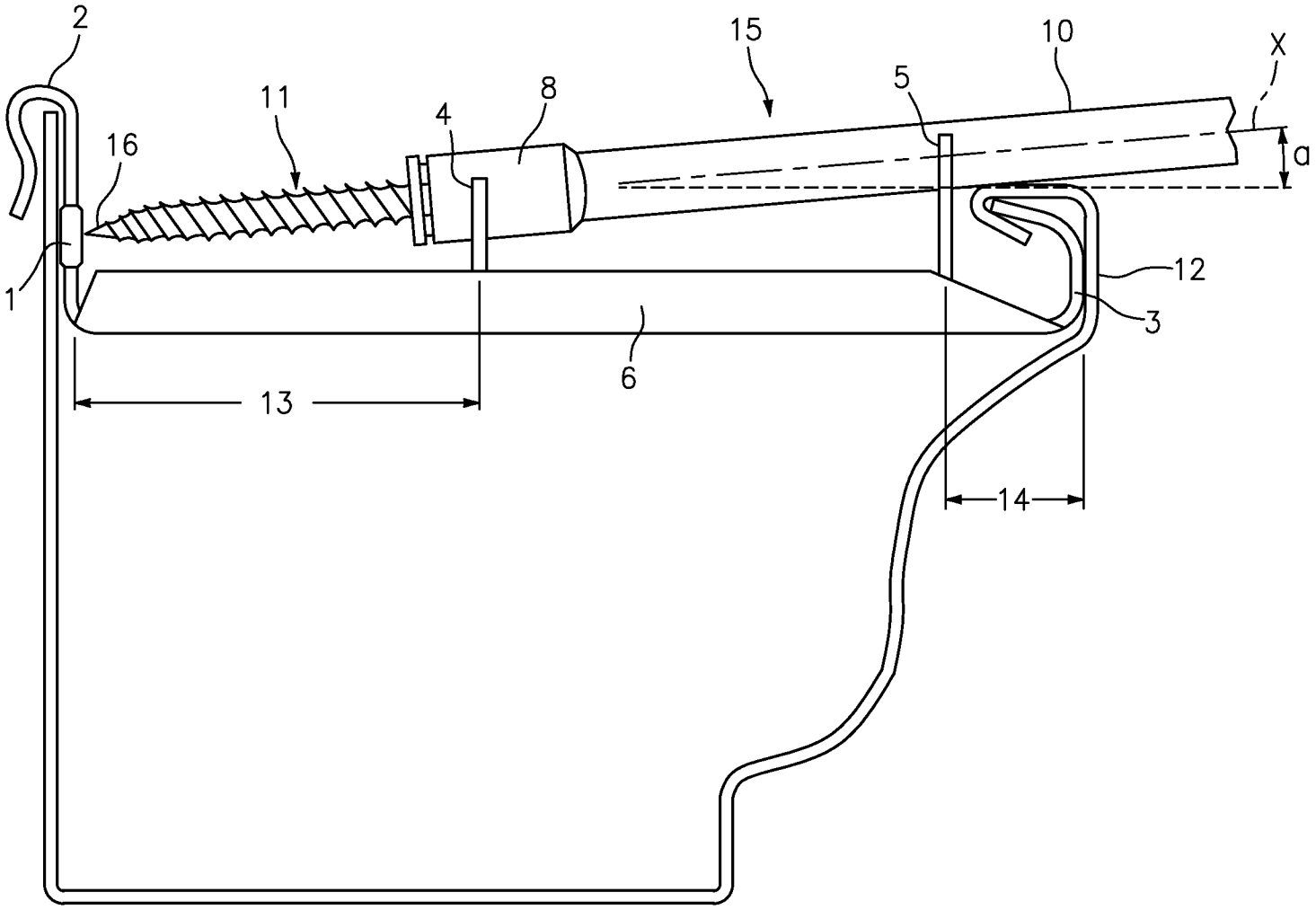
FIG. 4 depicts a K-style gutter with a gutter hanger snapped in place, a drive tool and a screw.

FIG. 4 depicts a K-style gutter with a gutter hanger 20 snapped in place, a drive tool 15 and a screw 11. It is understood the gutter hanger 20 may be used with other types of gutters and is not limited to use with K-style gutters. The front hook 3 has been rotated within the front lip 12 of the gutter. The back clip 2 has been snapped over the top of the back of the gutter. In the example of FIG. 4, the first guide tab 4 is about 2 inches from back clip 2 to properly accommodate a standard 1.5 inch gutter screw 11. In general, the first guide tab 4 is positioned from the rear clip 2 by a distance greater than a screw length. For example, for a 1 inch screw, the first guide tab 4 is positioned from the rear clip 2 by a distance of about 1.5 inches. In general, the first guide tab 4 is positioned from the rear clip 2 by a distance of a screw length plus an offset.

The second guide tab 5 may be positioned as far forward as possible without interfering with the installation of the gutter hanger 20 when rotating the front hook 3 into the front lip 12 of the gutter. In the example of FIG. 4, the second guide tab is about ⅝ inches from the front hook 3 of the gutter hanger 20, maximizing the distance between the first guide tab 4 and the second guide tab 5 for most effective guidance of the drive tool 15.

In use, the drive tool 15 will slide rearward while being supported by the first guide tab 4 and the second guide tab 5 until the point 16 of the gutter screw 11 goes through the back hole 1 in the rear clip 2, at which time the point 16 contacts the back panel of the gutter and is driven through into the fascia, attaching the gutter to the building.

In the example of FIG. 4, the drive tool 15 (e.g., a zip screwdriver or nut driver) includes a shank 10 and a magnetic chuck 8 (e.g., ¼ inch chuck). The drive tool 15 with a magnetically retained gutter screw 11 is shown in position for installation. The drive tool 15 is supported and guided by the first guide tab 4 and the second guide tab 5. The chuck 8 of the drive tool 15 rests in the first guide notch 7 in the first guide tab 4 and the shank 10 of the drive tool 15 rests in the second guide notch 9 of the second guide tab 5. The positioning is such that the point 16 of the gutter screw 11 is spaced forward of the rear clip 2, so as not to dislodge the gutter screw 11 from being retained magnetically by the chuck 8. The alignment of the drive tool 15, effected by the guide tabs 4 and 5, causes the point 16 of the gutter screw 11 to easily find the back hole 1 of the gutter hanger when the driver is axially advanced.

Once the point 16 of screw 11 contacts the back panel of the gutter, the drive tool 15 is energized by the installer (e.g., a drill drives the drive tool 15) and axial pressure is applied, causing the point 16 of screw 11 to penetrate the back panel of the gutter and advance into the building fascia. During this critical, unstable period, the guide tabs 4 and 5 steady the drive tool 15 to prevent possible buckling and dislodgement of the gutter screw 11, which is only weakly retained by the magnetic chuck 8.

The gutter screw 11 may have a ¼ inch hex head to fit the standard driver that is used on most gutter screws, including shorter pointed screws that are used to assemble gutter components, as well as heavier, longer, screws for gutter hangers. Gutter screw 11 is magnetic, even if made from stainless steel, for retention in the magnetic chuck 8. Gutter screw 11 may have varying diameters such as, for example, #10 (0.190"), #11 (0.203"), and #12 (0.216"). Installers select a screw diameter depending on their preference and the particulars of a given installation. The gutter screw length needs to be sized appropriately. The vast majority of gutter screws are 1.5 inches long, measured from the point to the underside of the washer hex head. There may be modest manufacturing variations, but the basic 1.5 inch screw length is the standard.

The back hole 1 in the gutter hanger 20 may have an about 0.230 inch diameter, accepting even the largest gutter screw 11 while allowing for as much as 0.100 inches misalignment. The point of the gutter screw 11 does not need to be precisely on center; as long as it goes through the hole 1 in the gutter hanger 20 and can penetrate and engage the back panel of the gutter without having the threads get hung up by the side wall of the hole in the hanger, it will have done its job.

Many homeowners want to have covers on their gutters to keep out leaves and debris. Many of these covers rest directly on the upper surface of the gutter, some even rest below this plane to discourage water from flowing over the front edge of the gutter. Most captive screw hangers project above this plane and interfere with gutter covers. The gutter hanger 20 is superior to captive screw hangers in that the guide tabs 4 and 5 can be easily bent down once they have done their job, so any gutter cover can be readily installed.

The gutter hanger 20 makes gutter installation faster and easier by providing guidance for the drive tool 15 that is used to drive gutter screws 11. The gutter hanger 20 simplifies gutter installation, it has no added cost elements of material or labor in its manufacture.

The term "about" is intended to include the degree of error associated with measurement of the particular quantity and/or manufacturing tolerances based upon the equipment available at the time of filing the application.

It is understood that the embodiments of the present invention as shown and described are to be regarded as merely illustrative, and that the invention is susceptible to variations, modifications and changes, without regard to specific construction methods, within scope of the appended claims.

What is claimed is:

1. A gutter hanger comprising:

a main body;

a rear clip at a first end of the main body;

a front hook at a second end of the body;

a first guide tab located proximate the rear clip, the first guide tab including a first guide notch formed therein, the first guide notch located at a distal end of the first guide tab defining an open end of the first guide tab, a widest portion of the first guide notch positioned at the distal end of the first guide tab when installed;

a second guide tab located proximate the front hook, the second guide tab including a second guide notch formed therein, the second guide notch located at a distal end of the second guide tab defining an open end of the second guide tab, a widest portion of the second guide notch positioned at the distal end of the second guide tab when installed;

wherein the first guide tab and the second guide tab are sized and positioned to align a drive tool relative to the main body;

wherein the widest portion of the first guide notch is wider than the widest portion of the second guide notch, the first guide notch sized to receive a chuck of the drive tool, the second guide notch sized to receive a shaft of the drive tool;

wherein the first guide tab is located at least one inch from the rear clip;

wherein the second guide tab is about ⅝ inch from the front hook.

2. The gutter hanger of claim 1 wherein:

the first guide notch is V-shaped.

3. The gutter hanger of claim 1 wherein:

the second guide notch is V-shaped.

4. The gutter hanger of claim 1 wherein:

a height of the second guide tab is greater than a height of the first guide tab.

5. The gutter hanger of claim 1 wherein:

the second guide tab and the first guide tab are sized to align a longitudinal axis of a drive tool at an angle relative to a plane main body.

6. The gutter hanger of claim 1 wherein:

an axis passing through a bottom of the first guide notch and a bottom of the second guide notch forms an acute angle with respect to a plane of the main body.

7. The gutter hanger of claim 1 wherein:

the first guide tab is located about 2 inches from the rear clip.

8. The gutter hanger of claim 1 wherein:

the first guide tab is stamped from the main body.

9. The gutter hanger of claim 1 wherein:

the first guide tab is bendable relative to the main body.

10. The gutter hanger of claim 1 wherein:

the first guide tab is located at least 1.5 inches from the rear clip.

11. A gutter hanger comprising:

a main body;

a rear clip at a first end of the main body;

a front hook at a second end of the body;

a first guide tab located proximate the rear clip, the first guide tab including a first guide notch formed therein, the first guide notch located at a distal end of the first guide tab defining an open end of the first guide tab, the first guide notch being about 0.430 inches to about 0.440 inches wide at a widest point;

a second guide tab located proximate the front hook, the second guide tab including a second guide notch formed therein, the second guide notch located at a distal end of the second guide tab defining an open end of the second guide tab, the second guide notch being about 0.310 inches to about 0.350 inches wide at a widest point;

wherein the first guide tab is spaced from the rear clip by at least one inch;

wherein the second guide tab is about ⅝ inch from the front hook.

12. A gutter hanger comprising:

a main body;

a rear clip at a first end of the main body;

a front hook at a second end of the body;

a first guide tab located proximate the rear clip, the first guide tab including a first guide notch formed therein, the first guide notch located at a distal end of the first guide tab defining an open end of the first guide tab;

a second guide tab located proximate the front hook, the second guide tab including a second guide notch formed therein, the second guide notch located at a distal end of the second guide tab defining an open end of the second guide tab;

wherein the first guide tab and the second guide tab are sized and positioned to align a drive tool relative to the main body;

wherein the first guide tab is spaced from the rear clip by at least one inch;

wherein the second guide tab is about ⅝ inch from the front hook;

wherein a widest portion of the first guide notch is wider than a widest portion of the second guide notch, the first guide notch sized to receive a chuck of the drive tool, the second guide notch sized to receive a shaft of the drive tool.

13. The gutter hanger of claim 12 wherein:

the first guide tab is located about 1.5 inches to about 2 inches from the rear clip.

* * * * *